United States Patent [19]

Bartok et al.

[11] 4,407,206

[45] Oct. 4, 1983

[54] PARTIAL COMBUSTION PROCESS FOR COAL

[75] Inventors: William Bartok, Westfield; Howard Freund, Somerville, both of N.J.

[73] Assignee: Exxon Research and Engineering Co., Florham Park, N.J.

[21] Appl. No.: 376,725

[22] Filed: May 10, 1982

[51] Int. Cl.[3] ..... F23D 1/00

[52] U.S. Cl. ..... 110/347; 48/210; 110/229; 110/230; 431/10

[58] Field of Search ..... 110/347, 229, 230, 263, 110/341, 266; 48/101, 210, 197 R; 431/10

[56] References Cited

U.S. PATENT DOCUMENTS

| | | | |
|---|---|---|---|
| 855,548 | 11/1977 | Blair . | |
| 2,830,883 | 4/1958 | Eastman . | |
| 3,969,089 | 7/1976 | Moss . | |
| 4,021,186 | 5/1977 | Tenner . | |
| 4,026,679 | 5/1977 | Collin . | |
| 4,060,397 | 11/1977 | Buiter . | |
| 4,226,601 | 10/1980 | Smith | 110/347 X |
| 4,246,853 | 1/1981 | Mehta | 110/347 |
| 4,285,283 | 8/1981 | Lyon . | |

OTHER PUBLICATIONS

EPA-600/7-78-153b published 11/78, "Sulfur Retention in Coal Ash".

Reprint from AlChe Symposium Series vol. 67, No. 116, 1971, "The Scale-Up of a Fluidized Bed Combustion System to Utility Boilers".

Battelle Energy Program Report dated 12/15/75, "Experimental Studies on the Feasibility of In-Furnace Control of $SO_2$ and $NO_2$ Emissions from Industrial Stokers".

Battelle Energy Program Report dated 11/15/75 "The Super-Slagging Gasifier-Demonstration of Desulfurizing Principle".

Paper by Energy and Environmental Research Corporation, "The Generalization of Low Emission Coal Burner Technology".

*Primary Examiner*—Edward G. Favors

*Attorney, Agent, or Firm*—Henry E. Naylor

[57] ABSTRACT

Disclosed is a process for combusting coal containing more than 1 wt. % sulfur which process comprises (a) providing a coal containing more than 1 wt. % sulfur and containing an organically bound calcium to sulfur ratio of at least about 0.8 to 1, (b) burning the coal to about 80% to 95% carbon conversion at temperatures greater than about 1,100° C. in a first combustion zone in the presence of an oxidizing agent but under reducing conditions such that the equivalence ratio of coal to oxidizing agent is less than 1.5 but greater than or equal to 1.0, (c) separating the resulting solid effluent from the gaseous effluent from the first combustion zone, and (d) burning the gaseous effluent at a temperature from about 1,000° C. to about 1,500° C. in a second combustion zone under oxidizing conditions. A substantial amount of the sulfur of the coal is captured in the resulting solid effluent.

8 Claims, 1 Drawing Figure

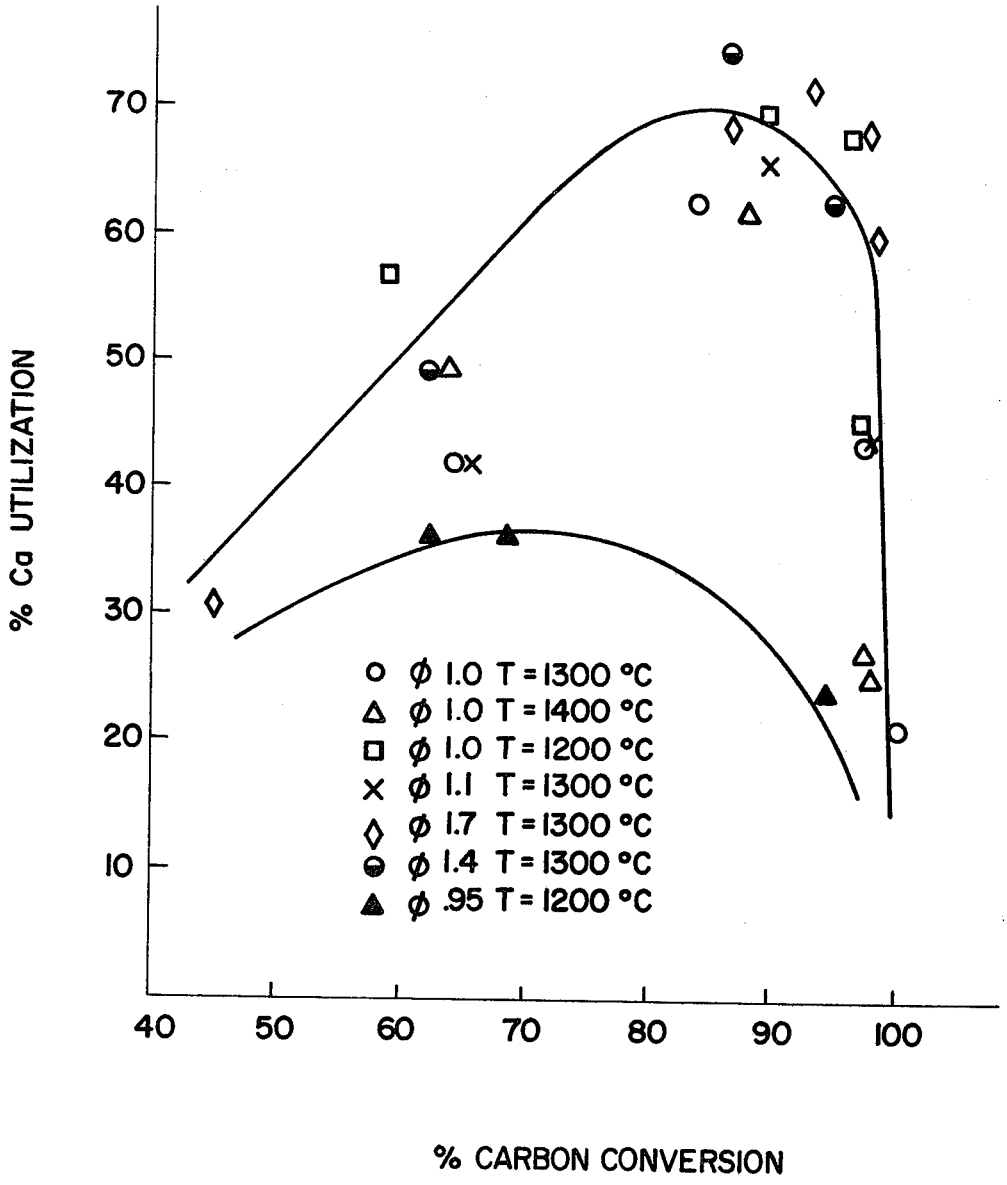
% Ca UTILIZATION
70
60
50
40
30
20
10
40
50
60
70
80
90
100
% CARBON CONVERSION
○ ϕ 1.0 T = 1300 °C
△ ϕ 1.0 T = 1400 °C
□ ϕ 1.0 T = 1200 °C
× ϕ 1.1 T = 1300 °C
◇ ϕ 1.7 T = 1300 °C
◒ ϕ 1.4 T = 1300 °C
▲ ϕ .95 T = 1200 °C

PARTIAL COMBUSTION PROCESS FOR COAL

BACKGROUND OF THE INVENTION

The present invention relates to a method for partially combusting coal which contains at least about 1 wt.% sulfur wherein a major portion of the sulfur content of the coal is retained in the solid effluents.

Although coal is by far our most abundant fossil fuel, there are serious problems associated with its use which has prevented coal from reaching its full commercial exploitation. Examples of some such problems include problems in handling, waste disposal, and pollution. As a result, oil and natural gas have acquired a dominant position throughout the world from the standpoint of fuel sources. This, of course, has led to depletion of proven petroleum and natural gas reserves to a dangerous level from both a worldwide energy, as well as an economic point of view.

One area in which it is desirable to replace petroleum and gas with coal as an energy source, is in industries where coal can be burned in combustion devices such as boilers or furnaces. Owing to environmental considerations, the gaseous effluents resulting from the combustion of coal in these devices must be substantially pollution free—especially with respect to oxides of sulfur ($SO_x$) and nitrogen ($NO_x$). One method conventionally employed for controlling $SO_x$ emissions is by flue gas scrubbing. The cost of flue gas scrubbing is prohibitive on small installations and excessive on large scale operations. There are also serious operating problems associated with flue gas scrubbing.

A two stage coal combustion process for minimizing $SO_x$ emissions is disclosed in U.S. Pat. No. 4,285,283 which is incorporated herein by reference. The process requires a coal having an organic calcium to sulfur ratio of at least 2 to 1 for coals containing less than 1 wt.% sulfur and a ratio of at least 1 to 1 for coals containing greater than 1 wt.% sulfur. The first stage requires combustion in the presence of an oxidizing agent at an equivalence ratio of at least 1.5. The second stage requires combustion of the gaseous effluents under oxidizing conditions at a temperature from about 1,000° C. to about 1,500° C.

Although such processes have met with varying degrees of success in a commercial environment, there is still a need in the art for alternative combustion processes for minimizing $SO_x$ emissions without sacrificing fuel utilization to an undesirable degree.

SUMMARY OF THE INVENTION

In accordance with the present invention there is provided a process for partially combusting a coal containing more than 1 wt.% sulfur, wherein the generation of $SO_x$ is minimized, which process comprises: (a) providing a coal containing more than about 1 wt.% sulfur and containing an organically bound calcium to sulfur ratio of at least about 0.8 to 1, (b) burning the coal to about 80% to 95% carbon conversion at temperatures greater than about 1,100° C. in a first combustion zone in the presence of an oxidizing agent but under reducing conditions such that the equivalence ratio of coal to oxidizing agent is less than 1.5 but greater than or equal to 1.0, (c) separating the resulting solid effluent from the gaseous effluent from the first combustion zone, and (d) burning the gaseous effluent at a temperature from about 1,000° C. to about 1,500° C. in a second combination zone under oxidizing conditions.

In a further embodiment of the present invention char can be separated from the solid effluents and treated to remove substantially all of the sulfur content which is present in the form of water soluble calcium sulfide. The treated char is now in the form suitable for use as a low-sulfurcontaining fuel.

BRIEF DESCRIPTION OF THE FIGURES

The present invention will be further illustrated by reference to FIG. 1 which shows a critical band of carbon conversion at 80 to 95%, at which sulfur capture is maximized.

DETAILED DESCRIPTION OF THE INVENTION

Coals suitable for the practice of the present invention are those coals which contain greater than 1 wt.% sulfur and which contain organically bound calcium in an amount such that the atomic ratio of organically bound calcium to sulfur is at least about 0.8 to 1.

As is well known, coals are mixtures of organic carbonaceous materials and mineral matter. As is also well-known, coals may contain metallic elements, such as calcium, in two forms: as mineral matter, e.g., separate particles of calcium carbonate, and organically bound, such as salts of humic acids dispersed throughout the organic phase. Although inorganic form of calcium which may naturally be present in coal, may be of some benefit for capturing sulfur in the practice of the present invention, it is the organically bound calcium which is of major importance.

Coals which are suitable for use in the practice of the present invention are those coals which contain organically bound calcium in a sufficient amount to capture, in the resulting solid effluent, a substantial amoount of the sulfur content of the coal. Although theoretically, a stoichiometric amount of calcium to sulfur (1 to 1) will capture 100% of the sulfur in the solid effluent, more or less than a stoichiometric amount may be employed depending on such things as the economics of the process, the process conditions employed, and the predetermined level of sulfur capture. Since organically bound calcium may be removed or added to coal by ion exchange, it is often referred to as ion exchangeable calcium. For purposes of the present invention the coal which is employed should contain organically bound calcium to sulfur in a ratio of at least about 0.8 to 1. The precise amount of organically bound calcium needed in a particular coal in the practice of the present invention can be easily determined by routine experimentation by one having ordinary skill in the art.

It is rare for a coal with more than one weight percent sulfur to possess organically bound calcium in an amount suitable for use in the practice of the present invention, although it is possible for some coals to have a ratio of ion exchangeable sites to sulfur greater than 2. These coals are typically lignites and to a lesser degree subbituminous coals. It is taught in Catalysis Review 14(1), 131–152 (1976) that one may increase the calcium content on coals containing exchangeable sites by ion exchange. This may be done by washing with an aqueous solution of calcium ions. Accordingly, it is within the scope of this invention to use coals which are found in nature to possess adequate atomic ratios of organically bound calcium to sulfur as well as to use coals whose organically bound calcium to sulfur ratio has been increased by such techniques as ion exchange.

Many other coals, especially bituminous and anthracite coals either do not possess a sufficient amount or organically bound calcium for the practice of the present invention or they do not possess enough sites onto which a sufficient amount of calcium can be ion exchanged. The ion exchangeable sites are typically carboxyl and hydroxyl groups, more typically carboxyl. These sites may be formed by mild oxidation either in a separate step or concurrently with calcium exchange. This mild oxidation may be performed by any means known in the art, including the techniques taught in U.S. patent application Ser. No. 6,700, filed Jan. 26, 1979 and incorporated herein by reference. Another method suitable for ion exchanging calcium into the coal structure is that method taught in co-pending U.S. patent application Ser. No. 06/373,883 filed May 3, 1982. It is taught in the co-pending application, which is also incorporated herein by reference, that organically bound calcium can be incorporated into a coal structure by contacting the coal with an aqueous medium containing alkali and/or alkaline earth metal cations. The coal is contacted at temperatures ranging from about 25° C. to about 100° C. in the presence, and in contact with an oxidizing atmosphere, such as air.

Because coal is, in general, a very porous substance, it is not critical to grind it into a finely divided state in order to carry out a mild oxidation ion exchange procedure. Such procedure may, however, be carried out with somewhat greater speed if the coal is of a relatively fine particle size. Accordingly, it is preferred to grind the coal, which is to be mildly oxidized and ion exchanged, to the finest particle size which is consistent with later handling and which is economically feasible.

The combustion process of the present invention is a multi-stage process, i.e., it involves a first combustion stage under reducing conditions, and a second combustion stage under oxidizing conditions. Any desired type of combustion apparatus (burner or chamber), can be utilized in the practice of this invention so long as the apparatus is capable of operating in accordance with the critical limitations as herein described. Further, the combustion apparatus employed in the second stage may be the same as, or different than, that employed in the first stage.

The first combustion stage of the present invention comprises mixing the coal with a first oxidizing agent, preferably air, so that the equivalence ratio of coal to oxidizing agent is less than 1.5 but greater than or equal to 1.0. This insures that the coal will burn in this stage under reducing conditions. The term equivalence ratio (usually referred to as $\phi$) for the purpose of this invention is defined as:

$$\text{equivalence ratio } \phi = \frac{\dfrac{\text{actual fuel}}{\text{actual oxidizing agent}}}{\dfrac{\text{stoichiometric fuel}}{\text{stoichiometric oxidizing agent}}}$$

As previously discussed, the temperature in this first combustion stage is from about 1,100° C. to about 1,500° C., preferably at least about 1,200° C. to about 1,400° C.

It is well-known that during fuel rich coal combustion, coal both oxidizes by reaction with $O_2$ and gasifies by reaction with $CO_2$, and $H_2O$. The former is strongly exothermic and rapid, while the latter is somewhat endothermic and in general less rapid. Consequently, if the reactor in which the first stage of combustion is carried out is not strongly backmixed, the temperature will be nonuniform, thereby achieving a peak value as the exothermic coal oxidation reaches completion and then declining as the endothermic gasification reaction proceeds. In this situation, the temperature of the first combustion zone, which must be greater than 1,200° C. and preferably greater than 1,400° C., is the peak temperature.

After the coal is burned in the first combustion stage, the resulting solid effluents (ash and char) are removed and the resulting gaseous effluents are burned in the second combustion stage. This second combustion stage, contrary to the first, is performed under oxidizing conditions. That is, the ratio of gaseous combustible gases from the first stage of combustion to air added to the second stage of combustion is less than that ratio which corresponds to stoichiometric combustion. This requirement of oxidizing conditions in the second stage is necessary in order to assure complete combustion of the pollutant carbon monoxide, which is well-known in the art. The preferred range for the equivalence ratio in the second stage is 0.98 to 0.50, this being the range of normal combustion practices. The temperature in the second stage of combustion should have a peak value greater than about 1,000° C. and less than about 1,500° C. Temperatures below 1,000° C. are not suitable because of problems encountered at lower temperatures such as flame instability and loss of thermal efficiency. Similarly, it is well-known in the art that under oxidizing conditions and at temperatures much above 1,500° C., atmospheric nitrogen is thermally oxidized to NO. Since this NO would then be emitted as an air pollutant, it is preferred to avoid its formation by operating the second stage of combustion at a peak temperature less than about 1,500° C.

The residence time of solids in the first combustion stage is preferably at least 0.1 seconds, while the residence time of gases in both the first and second stage of combustion is preferably in the range of 0.05 to 1 second.

The recovery of solids between the first and second combustion zones may be achieved by any suitable conventional means. The recovered solids will consist of a mixture of ash and char. Since the char is unused fuel, the amount recovered, instead of being burned or combusted is a function of the degree of carbon conversion. If carbon conversion is high (about 90–95%), the recovered solids will contain little char and the solids may be disposed of by any suitable means known in the art. During this disposal process, it may be desirable to oxidize the water soluble CaS in the ash to insoluble $CaSO_4$ in order to prevent the disposal of solids from creating a water polution problem. If carbon conversion is relatively low (less than about 90%), the recovered solids will contain significant amounts of char which may be used as fuel. It is well known in the art to operate fluid bed combustion systems in such a manner that $CaSO_4$ is thermodynamically stable and sulfur is thereby retained within the fluidized solids. Thus, the recovered solids could be used as fuel for a fluid bed combustor in such a manner that their heating value would be realized and the sulfur they contain could not be discharged to the atmosphere. Instead, the sulfur will leave the fluid bed combustor as $CaSO_4$ in the spent solids and can be disposed of with little or no environmental concerns.

Alternatively, the CaS may be removed from the solid effluent by various means known in the art. Because CaS is water soluble, one such means would be simple leaching with an aqueous or dilute mineral acid solution. The aqueous CaS solution can then be disposed of. Alternatively, the solid effluent can be treated with steam and $CO_2$ to convert the CaS to $CaCO_3$ and gaseous $H_2S$. The gaseous $H_2S$ can then be recovered and disposed of. Although an additional expense is encountered if CaS is removed from the solid effluent, the resulting char is, in terms of its sulfur content, a premium fuel which may be used in applications in which low sulfur fuels are critically required because other means of $SO_x$ emission control are nonfeasible.

The following examples serve to more fully describe the present invention, as well as to set forth the best mode contemplated for carrying out the invention. It is understood that these examples in no way serve to limit the true scope of this invention, but rather are presented for illustrative purposes.

Table II below shows the results of a series of experiments which were performed such that suspensions of coal having a particle size of 230/325 mesh, U.S. Sieve Size, were flowed downward through an alumina tube in an electric furnace. The gaseous atmosphere in the alumina tube for any given experiment was predetermined by the resulting equilibrium composition of the major species of the coal when the coal is burned at the corresponding equivalence ratio. Atmospheric pressure was employed for each experiment and the suspended solids were quenched by introducing nitrogen and were recovered by filtration. At the completion of each experiment, the recovered solids (ash and char) were analyzed for ash and sulfur. A Fischer Scientific Model 470 Sulfur Analyzer was used to measure sulfur content in the solids.

The composition of the gaseous atmosphere through which the coal was suspended was predetermined according to the desired equivalence ratio. Table I below sets forth the composition of the gaseous atmosphere for the respective equivalence ratio. The gaseous atmospheres remained substantially constant during the duration of any given experiment.

Residence times for coal were achieved by either recovering the solids from the alumina reaction tube and passing them, one or more times, through the reaction tube or by shortening the distance of the furnace zone where the reaction occurs. Sulfur species were introduced entirely as $H_2S$ for atmospheres based on an equivalence ratio of 1.1, 1.4, and 1.7; and as $SO_2$ for atmospheres based on an equivalence ratio of 1.0 and 0.95.

100 g of Illinois No. 6 coal was used for all the experiments in Table II below. Calcium was organically bound to the coal structures by first oxidizing the coal with air in a fluidized bed at a temperature of about 200° C. for 24 hours. The oxidized coal was then treated with an aqueous solution comprised of 500 g of water, 88 g of calcium acetate, and 30 g of ammonium hydroxide. After treatment, the coal was dried and was found to have a sulfur content of 2.9 wt.% and an organically bound calcium to sulfur atomic ratio of 1.1.

TABLE I

| Composition (in mol %) of Gaseous Atmosphere At Respective Equivalence Ratio | | | | | |
|---|---|---|---|---|---|
| | 0.95 | 1.0 | 1.1 | 1.7 | 1.7 |
| $H_2O$ | 13.9 | 14.0 | 14.0 | 14.0 | 13.0 |

TABLE I-continued

| Composition (in mol %) of Gaseous Atmosphere At Respective Equivalence Ratio | | | | | |
|---|---|---|---|---|---|
| $CO_2$ | 12.5 | 12.6 | 11.6 | 8.86 | 6.82 |
| $O_2$ | 1.0 | — | — | — | — |
| $N_2$ | balance | balance | balance | balance | balance |
| CO | | | 1.81 | 6.66 | 10.6 |
| $H_2$ | | | 1.26 | 5.46 | 10.6 |
| $SO_2$ | 3750 ppm | 3790 ppm | | | |
| $H_2S$ | | | 3290 ppm | 3280 ppm | 4120 ppm |

TABLE II

| Calcium Exchanged Illinois #6 Coal; Calcium to Sulfur = 1.1; 2.9 wt. % Sulfur | | | | | |
|---|---|---|---|---|---|
| Example | $\phi$ | Average T(°C.) | Residence Time Solids (seconds) | % Carbon conversion | % Calcium utilization |
| Comp. A | 0.95 | 1230 | 1.1 | 93.8 | 23.3 |
| | | | .8 | 62.1 | 35.6 |
| | | | .9 | 68.0 | 35.6 |
| 1 | 1.0 | 1230 | 1.1 | 58.9 | 56.6 |
| | | | 2.1 | 89.5 | 68.7 |
| | | | 3.1 | 96.4 | 66.5 |
| | | | 4.0 | 97.6 | 44.6 |
| 2 | 1.0 | 1330 | 1.1 | 83.7 | 61.8 |
| | | | 2.1 | 97.5 | 42.8 |
| | | | 3.1 | 99.9 | 20.2 |
| | | | .8 | 64.0 | 41.4 |
| | | | .5 | 29.2 | 20.6 |
| 3 | 1.0 | 1410 | 1.1 | 98.2 | 24.7 |
| | | | .9 | 97.7 | 26.0 |
| | | | .8 | 88.0 | 60.9 |
| | | | .6 | 63.7 | 49.0 |
| 4 | 1.1 | 1330 | 1.1 | 89.8 | 64.8 |
| | | | 2.1 | 98.0 | 48.0 |
| | | | .8 | 65.1 | 41.8 |
| | | | .5 | 27.1 | 20.9 |
| 5 | 1.4 | 1330 | 1.1 | 86.1 | 74.2 |
| | | | 2.1 | 95.3 | 62.0 |
| | | | .8 | 61.9 | 49.2 |
| | | | .5 | 24.5 | 14.9 |
| 6 | 1.7 | 1330 | 1.1 | 86.4 | 67.8 |
| | | | 2.1 | 93.1 | 71.3 |
| | | | 3.1 | 96.7 | 66.4 |
| | | | 4.0 | 98.2 | 59.3 |
| | | | .8 | 45.3 | 30.5 |

A plot of the data in Table II above is represented in FIG. No. 1 herein. FIG. 1 clearly shows a critical band of carbon conversion at 80 to 95%, at which sulfur capture is maximized. Also shown in FIG. 1 is the criticality of operating at an equivalence ratio greater than or equal to 1.

COMPARATIVE EXAMPLE B

The procedure used in the above examples was employed except low sulfur Wyoming coal containing naturally occurring organic calcium was used. The coal contained 0.55 wt.% sulfur (based on the total weight of the coal) and an organic calcium to sulfur ratio of 2. The results are set forth in Table III below:

TABLE III

| $\phi$ | T(°C.) | Residence Time Solids (seconds) | % Carbon conversion | % Calcium utilization |
|---|---|---|---|---|
| 1.5 | 1330 | 1.1 | 69.9 | 12.5 |
| | | 2.1 | 94.8 | 16.6 |
| | | 3.1 | 97.5 | 13.3 |

This comparative example illustrates the importance of employing coal having a sulfur content in excess of about 1 wt.% in the practice of the present invention.

COMPARATIVE EXAMPLE C

The above procedure was followed except 1.8 g of Illinois #6 coal, which was not ion-exchanged with calcium, was employed and was mixed with 0.2 g of calcined Grove limestone. The resulting mixture had a sulfur content of 3.4 wt.% and a calcium to sulfur atomic ratio of 1.6. The mixture was passed through the alumina tube at a temperature of 1330° C., at atmospheric pressure, and in a gaseous atmosphere corresponding to an equivalence ratio of 1.0. At a carbon conversion level of 85% only 3% of calcium was utilized to capture sulfur. This degree of sulfur capture is much lower than that achieved with Illinois #6 coal which was treated so that it contained a suitable amount of organically bound calcium. Thus, it is critical that the calcium be organically bound to the coal structure as opposed to a physical mixture of inorganic calcium salts and coal.

What is claimed is:

1. A process for partially combusting coal which contains greater than about 1 wt.% sulfur, wherein the generation of $SO_x$ is minimized, which process comprises:

(a) providing a coal containing more than about 1 wt.% sulfur and containing organically bound calcium to sulfur in a ratio of at least about 0.8 to 1;

(b) burning the coal to about 80% to 95% carbon conversion at temperatures greater than about 1,100° C. in a first combustion zone in the presence of an oxidizing agent but under reducing conditions such that the equivalence ratio of coal to oxidizing agent is less than 1.5 but greater than or equal to 1.0;

(c) separating the resulting solid effluent from the gaseous effluent from the first combustion zone; and (d) burning the gaseous effluent at a temperature from about 1,000° C. to about 1,500° C. in a second combustion zone under oxidizing conditions.

2. The process of claim 1 wherein the coal is burned to about 90 to 95% carbon conversion.

3. The process of claim 1 or 2 wherein organically bound calcium to sulfur is present in a stoichiometric amount.

4. The process of claim 3 wherien the solid effluent is treated to reduce its sulfur content.

5. A process for partially combusting coal which contains greater than about 1 wt.% sulfur, wherein the generation of $SO_x$ is minimized, which process comprises:

(a) treating the coal by ion exchange so that organically bound calcium to sulfur is present in a ratio of at least about 0.8 to 1;

(b) burning the coal to about 80% to 95% carbon conversion at temperatures greater than about 1,100° C. in a first combustion zone in the presence of an oxidizing agent but under reducing conditions such that the equivalence ratio of coal to oxidizing agent is less than 1.5 but greater than or equal to 1.0;

(c) separating the resulting solid effluent from the gaseous effluent from the first combustion zone; and (d) burning the gaseous effluent at a temperature from about 1,000° C. to about 1,500° C. in a second combustion zone under oxidizing conditions.

6. The process of claim 5 wherein the coal is burned to about 90 to 95% carbon conversion.

7. The process of claim 5 or 6 wherein organically bound calcium to sulfur is present in a stoichiometric amount.

8. The process of claim 7 wherein the solid effluent is treated to reduce its sulfur content.

* * * * *